US005839311A

United States Patent [19]

Grenfell et al.

[11] Patent Number: 5,839,311

[45] Date of Patent: Nov. 24, 1998

[54] COMPOSITION TO AID IN THE FORMING OF METAL

[75] Inventors: Mark W. Grenfell, Woodbury; Dean S. Milbrath; Daniel D. Krueger, both of Stillwater; Richard M. Flynn, Mahtomedi; Frederick E. Behr, Woodbury, all of Minn.

[73] Assignee: Minnesota Mining and Manufacturing Company, St. Paul, Minn.

[21] Appl. No.: 715,206

[22] Filed: Sep. 17, 1996

[51] Int. Cl.[6] ..... B21B 45/02

[52] U.S. Cl. ..... 72/42; 72/40; 508/208; 508/182; 508/207; 508/406; 252/52; 252/171; 260/611; 510/410; 510/411

[58] Field of Search ..... 508/406, 462, 508/504, 508, 510, 513, 208, 182, 207, 257; 72/40, 42, 43; 51/408, 411; 252/52, 54, 68, 171, 77; 510/410, 411

[56] References Cited

U.S. PATENT DOCUMENTS

| | | | |
|---|---|---|---|
| 3,129,182 | 4/1964 | McLean . | |
| 3,280,027 | 10/1966 | Pierre et al. . | |
| 3,365,397 | 1/1968 | Kolarik . | |
| 3,756,052 | 9/1973 | Quaal et al. . | |
| 3,946,083 | 3/1976 | Delaunois et al. | 257/77 |
| 4,224,173 | 9/1980 | Reick . | |
| 4,428,851 | 1/1984 | Hisamoto et al. . | |
| 4,430,234 | 2/1984 | Hasegawa et al. . | |
| 4,492,641 | 1/1985 | Buchwald et al. . | |
| 4,497,720 | 2/1985 | Moriga et al. | 508/406 |
| 4,559,153 | 12/1985 | Baldwin et al. . | |
| 4,639,323 | 1/1987 | Liao . | |
| 4,659,488 | 4/1987 | Vinci . | |
| 4,736,045 | 4/1988 | Drakesmith et al. . | |
| 4,885,414 | 12/1989 | Schweighardt et al. | 570/130 |
| 4,983,229 | 1/1991 | Tull | 148/246 |
| 5,032,306 | 7/1991 | Cripps | 252/68 |
| 5,091,104 | 2/1992 | Van Der Puy | 510/410 |
| 5,146,014 | 9/1992 | Graybill et al. . | |
| 5,154,845 | 10/1992 | Williams | 508/545 |
| 5,198,139 | 3/1993 | Bierschenk et al. . | |
| 5,211,861 | 5/1993 | Lafratta et al. . | |
| 5,393,442 | 2/1995 | Buchwald et al. . | |
| 5,476,974 | 12/1995 | Moore et al. | 568/677 |
| 5,547,593 | 8/1996 | Sanechika et al. . | |
| 5,605,882 | 2/1997 | Klug et al. . | |
| 5,676,005 | 10/1997 | Balliett | 72/42 |

FOREIGN PATENT DOCUMENTS

| | | | |
|---|---|---|---|
| 0 412 788 | 2/1991 | European Pat. Off. | C10M 173/02 |
| 0 553 437 | 8/1993 | European Pat. Off. | B23K 35/40 |
| 0 565 118 | 10/1993 | European Pat. Off. | C01M 107/38 |
| 1 403 628 | 8/1975 | United Kingdom | C10M 3/24 |
| WO96/22356 | 7/1996 | WIPO | C11D 7/50 |
| WO 97/35673 | 10/1997 | WIPO | B21B 45/02 |

OTHER PUBLICATIONS

Jean C. Childers, *The Chemistry of Metalworking Fluids,* Metal–Working Lubricants, pp. 165–189 (Jerry P. Byers ed., 1994).

Pamela S. Zurer, *Looming Ban on Production of CFCs, Halons Spurs Switch to Substitutes,* Chem. & Eng'g News, Nov. 15, 1993 pp. 12–18.

Flourinert™ Electronic Fluids, product bulletin 98–0211–6086(212)NPI, issued Feb. 1991, available from 3M Co., St. Paul, Minn.

Betzalel Avitzur, *Metal Forming,* Encyclopedia of Physical Science and Technology, vol. 9, pp. 652–682 (Academic Press, Inc. 1992).

Leigh Mummery, Surface Texture Analysis the Handbook, Chpt. 3, pp. 26–31 and 46–51 (Hommelwerke GmbH 1990).

E. Paul DeGarmo et al., *The Fundamentals of Metal Forming, Materials and Processes in Manufacturing,* 7th ed., pp. 394–408 (Macmillan Publishing Co. 1998).

*Primary Examiner*—W. Donald Bray
*Attorney, Agent, or Firm*—John A. Burtis

[57] ABSTRACT

In one aspect, this invention provides a lubricating and colling composition for the forming of metals comprising a hydrofluoroether. In another aspect, the present invention provides a method of forming metals comprising applying to the metal and the workpiece a composition comprising a hydrofluoroether.

20 Claims, 2 Drawing Sheets

COMPOSITION TO AID IN THE FORMING OF METAL

FIELD OF THE INVENTION

This invention relates to metal forming operations, particularly to bulk and secondary metal forming operations, and more particularly it relates to lubricating and cooling fluids used during such operations.

BACKGROUND OF THE INVENTION

Metals may be molded and shaped into a desired form by methods of forming that are similar in nature to the molding of pottery. Although many in number and widely varied in particular characteristic, methods of forming metal share the common, basic attribute of applying an external force to a metal to deform the metal without removing or otherwise cutting or abrading the metal to be shaped. For a detailed description of the basic metal forming methods see, for example, Betzalel Avitzur, *Metal Forming,* in 9 ENCYCLOPEDIA OF PHYSICAL SCIENCE AND TECHNOLOGY 651-82 (1992).

In most metal forming processes, it is necessary to provide a lubricant at the interface between the tool and the workpiece. Generally, to serve this purpose various metal working fluids are utilized. Currently utilized metal forming fluids fall generally into two basic categories. A first, older class comprises oils and other organic chemicals that are derived principally from petroleum, animal, or plant substances. Widely used oils and oil-based substances include, for example, saturated and unsaturated aliphatic hydrocarbons such as n-decane, dodecane, turpentine oil, and pine oil, naphthalene hydrocarbons, polyoxyalkylenes such as polyethylene glycol, and aromatic hydrocarbons such as cymene. While these oils are widely available and are relatively inexpensive, their utility is significantly limited; because they are most often nonvolatile under the working conditions of a metalworking operation, they leave residues on tools and working pieces, requiring additional processing at significant cost for residue removal.

A second, newer class of lubricating fluids for metal forming includes chlorofluorocarbons (CFCs), hydrochlorofluorocarbons (HCFCs), and perfluorocarbons (PFCs). Of these three groups of fluids, CFCs are the most useful and are historically the most widely employed. See, e.g., U.S. Pat. No. 3,129,182 (McLean). Typically used CFCs include trichloromonofluoromethane, 1,1,2-trichloro-1,2,2-trifluoroethane, 1,1,2,2-tetrachlorodifluoroethane, tetrachloromonofluoroethane, and trichlorodifluoroethane. While these compositions initially were believed to be environmentally benign, they are now known to be damaging to the environment. CFCs and HCFCs are linked to ozone depletion (see, e.g., P. S. Zurer, *Looming Ban on Production of CFCs, Halons Spurs Switch to Substitutes,* CHEM. & ENG'G NEWS, Nov. 15, 1993, at 12). PFCs tend to persist in the environment (i.e. are not chemically altered or degraded under ambient environmental conditions).

Because metal forming is accomplished through the plastic deformation of a metal, metal forming processes performed without the aid of a lubricant, or with the aid of the aforementioned conventional lubricating fluids, causes a refinement, or a change in cystallization. Formed metals using conventional metal working fluids require annealing at an elevated temperature to reform the crystalline structure of the processed metal. Annealing is an added processing step that often accounts for a sizable portion of the overall metal forming process cost.

SUMMARY OF THE INVENTION

Briefly, in one aspect, this invention provides a lubricating and cooling composition for the forming of metals comprising a hydrofluoroether. In another aspect, the present invention provides a method of forming metals comprising applying to the metal and the workpiece a composition comprising a hydrofluoroether.

The hydrofluoroether fluids used in the forming of metals in accordance with this invention provide efficient lubricating and cooling media that efficiently transfer heat, are volatile, are non-persistent in the environment, and are non-corrosive. When used in the neat form, they also do not leave a residue on either the working piece or the tool upon which they are used, thereby eliminating otherwise necessary processing to clean the tool and/or workpiece and yielding a substantial cost savings. In many operations, the use of the hydrofluoroether compositions described herein will also eliminate the necessity of annealing a formed metal.

DETAILED DESCRIPTION OF PREFERRED EMBODIMENTS

Figure 1:
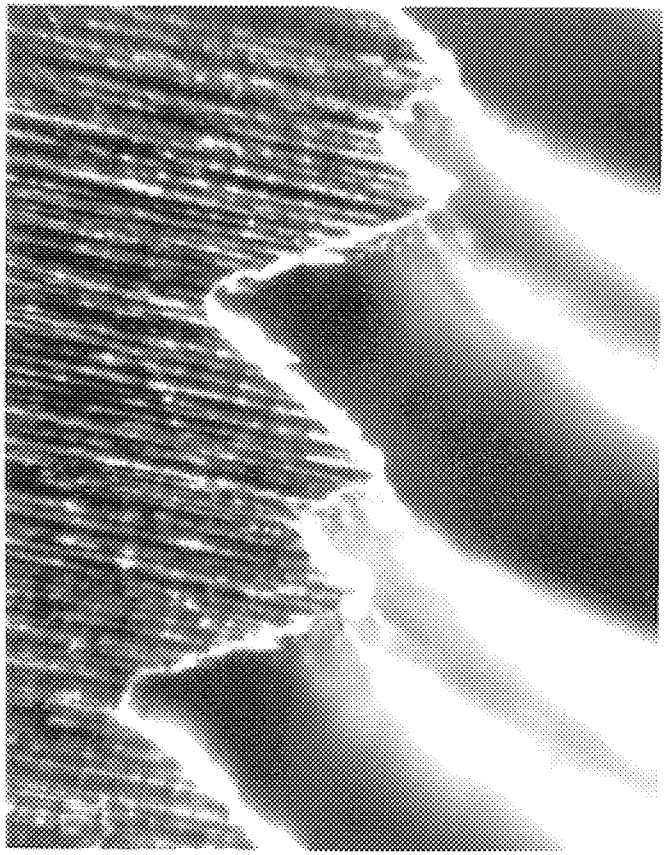
FIG. 1 provides a photomicrograph of a thread cross-section produced by a threadforming operation using a conventional metalworking fluid.

The hydrofluoroether fluids of the invention may be utilized as working fluids in any process involving the forming or other deformative working of any metal suitable to such operations. The most common, representative, processes involving the forming metals include: bulk deformation processes such as forging, rolling, rod, wire, and tube drawing, thread forming, extrusion, cold heading, and the like; and secondary metal forming processes such as deep drawing, stretch forming, knurling, spinning, shearing, punching, coining, and the like. Metals commonly subjected to forming operations include: refractory metals such as tantalum, niobium, molybdenum, vanadium, tungsten, haflium, rhenium, titanium; precious metals such as silver, gold, and platinum; high temperature metals such as nickel and titanium alloys and nickel chromes; and other metals including magnesium, bismuth, aluminum, steel (including stainless steels), brass, bronze, and other metal alloys. The use of hydrofluoroether fluids in such operations acts to cool the machining environment (i.e., the surface interface between a metal workpiece and a machining tool) by removing heat and particulate matter therefrom, and acts to lubricate machining surfaces, resulting in a smooth and substantially residue-free machined metal surface. In many operations their use will also eliminate the necessity of annealing.

The cooling and lubricating compositions of this invention comprise fluorinated ethers that may be represented generally by the formula:

$$(R_1—O)_n—R_2 \qquad (I)$$

where, in reference to Formula I, n is a number from 1 to 3 inclusive and $R_1$ and $R_2$ are the same or are different from one another and are selected from the group consisting of substituted and unsubstituted alkyl, aryl, and alkylaryl groups and their derivatives. At least one of $R_1$ and $R_2$ contains at least one fluorine atom, and at least one of $R_1$ and $R_2$ contains at least one hydrogen atom. Optionally, one or both of $R_1$ and $R_2$ may contain one or more catenary or noncatenary heteroatoms, such as nitrogen, oxygen, or sulfur. $R_1$ and $R_2$ may also optionally contain one or more functional groups, including carbonyl, carboxyl, thio, amino, amide, ester, ether, hydroxy, and mercaptan groups. $R_1$ and $R_2$ may also be linear, branched, or cyclic, and may contain one or more unsaturated carbon-carbon bonds. $R_1$ or $R_2$ or both of them optionally may contain one or more chlorine atoms provided that where such chlorine atoms are present there are at least two hydrogen atoms on the $R_1$ or $R_2$ group on which they are present.

Preferably, the cooling and lubricating compositions of the present invention comprise fluorinated ethers of the formula:

$$R_f—O—R \quad \text{(II)}$$

where, in reference to Formula II above, $R_f$ and R are as defined for $R_1$ and $R_2$ of Formula I, except that $R_f$ contains at least one fluorine atom, and R contains no fluorine atoms. More preferably, R is a noncyclic branched or straight chain alkyl group, such as methyl, ethyl, n-propyl, iso-propyl, n-butyl, i-butyl, or t-butyl, and $R_f$ is a fluorinated derivative of such a group. $R_f$ preferably is free of chlorine atoms, but in some preferred embodiments, R contains one or more chlorine atoms.

In the most preferred embodiments, $R_1$ and $R_2$, or $R_f$ and R, are chosen so that the compound has at least three carbon atoms, and the total number of hydrogen atoms in the compound is at most equal to the number of fluorine atoms. Compounds of this type tend to be nonflammable. Representative of this preferred class of hydrofluoroethers include $C_3F_7OCH_3$, $C_3F_7OC_2H_5$, $C_4F_9OCH_3$, $C_4F_9OCH_2Cl$, $C_4F_9OC_2H_5$, $C_7F_{13}OCH_3$, $C_7F_{13}OC_2H_5$, $C_8F_{15}OCH_3$, $C_8F_{15}OC_2H_5$ $C_{10}F_{21}OCH_3$, and $C_{10}F_{21}OC_2H_5$. Blends of one or more fluorinated ethers are also considered useful in practice of the invention.

Useful hydrofluoroether cooling and lubricating compositions may also comprise one or more perfluorinated compounds. Because a hydrofluoroether is most commonly more volatile than a perfluorinated fluid selected as a lubricious additive, a composition containing both a hydrofluoroether and a perfluorinated fluid preferably will comprise a minor amount, i.e., less than 50 weight percent of the perfluorinated fluid or fluids. Useful perfluorinated liquids typically contain from 5 to 18 carbon atoms and may optionally contain one or more caternary heteroatoms, such as divalent oxygen or trivalent nitrogen atoms. The term "perfluorinated liquid" as used herein includes organic compounds in which all (or essentially all) of the hydrogen atoms are replaced with fluorine atoms. Representative perfluorinated liquids include cyclic and non-cyclic perfluoroalkanes, perfluoroamines, perfluoroethers, perfluorocycloamines, and any mixtures thereof. Specific representative perfluorinated liquids include the following: perfluoropentane, perfluorohexane, perfluoroheptane, perfluorooctane, perfluoromethylcyclohexane, perfluorotripropyl amine, perfluorotributyl amine, perfluorotriamyl amine, perfluorotrihexyl amine, perfluoro-N-methylmorpholine, perfluoro-N-ethylmorpholine, perfluoro-N-isopropyl morpholine, perfluoro-N-methyl pyrrolidine, perfluoro-1,2-bis (trifluoromethyl)hexafluorocyclobutane, perfluoro-2-butyltetrahydrofuran, perfluorotriethylamine, perfluorodibutyl ether, and mixtures of these and other perfluorinated liquids. Commercially available perfluorinated liquids that can be used in this invention include: Fluorinert™ FC40, Fluorinert™ FC-43 Fluid, Fluorinert™ FC-71 Fluid, Fluorinert™ FC-72 Fluid, Fluorinert™ FC-77 Fluid, Fluorinert™ FC-84 Fluid, Fluorinert™ FC-87 Fluid, Fluorinert™ FC-8270, Performance Fluid™ PF-5060, Performance Fluid™ PF5070, and Performance Fluid™ PF-5052. Some of these liquids are described in Fluorinert™ Electronic Fluids, product bulletin 98-0211-6086(212)NPI, issued February 1991, available from 3M Co., St. Paul, Minn. Other commercially available perfluorinated liquids that are considered useful in the present invention include perfluorinated liquids sold as Galderm LS fluids, Flutec™ PP fluids, Krytox™ perfluoropolyethers, Demnum™ perfluoropolyethers, and Fomblin™ perfluoropolyethers.

In addition to one or more perfluorinated fluids, the hydrofluoroether compositions of the invention can, and typically will, include one or more conventional additives such as corrosion inhibitors, antioxidants, defoamers, dyes, bactericides, freezing point depressants, metal deactivators, and the like. The selection of these conventional additives is well known in the art and their application to any given method of cutting and abrasive working of metal is well within the competence of an individual skilled in the art.

One or more conventional base oils or other lubricious additives may also be appropriately added to the hydrofluoroether composition to optimize the lubricating nature of the composition. The most useful additives will be volatile (i.e., have a boiling point below about 250° C.) though others are also considered useful. Useful auxiliary lubricious additives would include, for example: saturated and unsaturated aliphatic hydrocarbons such as n-decane, dodecane, turpentine oil, and pine oil; naphthalene hydrocarbons; polyoxyalkylenes such as polyethylene glycol; aromatic hydrocarbons such as cymene; thiol esters and other sulfur-containing compounds; and chlorinated hydrocarbons including oligomers of chlorotrifluoroethylene, chlorinated perfluorocarbons, and other chlorine-containing compounds. Also useful are load-resistive additives such as phosphates, fatty acid esters, and alkylene glycol ethers. These latter classes of compounds include trialkyl phosphates, dialkylhydrogen phosphites, methyl and ethyl esters of $C_{10}$ to $C_{20}$ carboxylic acids, esters of monoalkyl ether polyethylene or ethylene glycols, and the like. Representative load-resistive additives include triethylphosphate, dimethylhydrogenphosphite, ethyl caproate, polyethylene glycol methylether acetate, and ethylene glycol monoethylether acetate.

One or more partially fluorinated or perfluorinated alkylated lubricious additives may also be added to the hydrofluoroether compositions to further optimize the lubricious properties of the composition. Such additives typically comprise one or more perfluoroalkyl groups coupled to one or more hydrocarbon groups through a functional moiety. Suitable perfluoroalkyl groups consist of straight-chain and branched, saturated and unsaturated $C_4$–$Cl_2$ groups, and useful hydrocarbon groups include straight-chain and branched, saturated and unsaturated $C_{10}$–$C_{30}$ groups. Suitable functional linking moieties can be groups comprising one or more heteroatoms such as O, N, S, P, or functional groups such as $—CO_2—$, $—CO—$, $—SO_2—$, $—SO_3—$, $—PO_4—$, $—PO_3—$, $—PO_2—$, $—PO—$, or $—SO_2N(R)—$ where R is a short chain alkyl group.

The lubricating compositions of the invention may be applied for the cutting and abrasive working of metals using any known technique. For example, the hydrofluoroether-containing compositions may be applied in either liquid or aerosol form, can be applied both externally, i.e. supplied to the tool from the outside, or internally, i.e. through suitable feed provided in the tool itself.

The following examples are offered to aid in the understanding of the present invention and are not to be construed as limiting the scope thereof. Unless otherwise indicated, all parts and percentages are by weight.

EXAMPLES

Examples 1 to 14 show hydrofluoroether coolant lubricant fluids used in the formation of threads in titanium with a cold forming bit. Comparative Examples C-1 to C-5 used a conventional coolant lubricant or other fluorinated fluids. In each of the Examples and Comparative Examples holes were drilled in a ¾" (1.9 cm) thick titanium block in rows spaced 1 ½" (3.8 cm) apart with an 8.8 mm high speed steel bit using a conventional water based coolant (Cimtech 3900™ available from Cincinnati Milacron) on a Mitsura MC-600VF™ CNC machine. After cleaning and drying the workpiece, these holes were threaded using a ⅜-16 bit (Chromflo™ GH 8 HSS) run at 10 surface feet/min (approx. 305 surface cm/min) for a 65% thread. A new threading bit was used for each fluid tested. Hydrofluoroether coolant lubricant fluids were applied to the bit and the hole from a plastic squeeze bottle at a flow rate of about 30–35 mL/min. Immediately after the bit was withdrawn from the workpiece its temperature and that of the threaded hole were measured with a type K thermocouple on an Omega™ Model H23 meter applied to the bit tip and the hole thread, respectively. These temperatures were recorded and averaged over three separate test holes and are shown on Table 1. Maximum load values as shown on the CNC machine were also recorded and are included in Table 1.

The work pieces were cut through the threaded holes so that the thread surface could be examined in cross section. All of the threads appeared to be fully formed with a slight discoloring of the threads in Example 2 and 7.

TABLE 1

| Example | Fluid | Bit Temperature (°C.) | Thread Temp. (°C.) | Load Meter (%) |
|---|---|---|---|---|
| 1 | $C_4F_9OCH_3$, commercially available from 3M as HFE ™-7100 | 166 (14) | 97 (15) | 72 |
| 2 | $C_4F_9OC_2H_5$ prepared as described in WO 96/22356 | 157 (12) | 103 (8) | 72 |
| 3 | $C_7F_{13}OCH_3$, prepared as described in WO 96/22356 using perfluorocyclohexyl carbonyl fluoride and dimethyl sulfate | 156 (9) | 84 (14) | 75 |
| 4 | $C_7F_{13}OC_2H_5$ prepared as described in WO 96/22356 using perfluorocyclohexyl carbonyl fluoride and diethyl sulfate | 147 (16) | 90 (6) | 72 |
| 5 | $C_2F_5CF(OCH_3)CF(CF_3)_2$ prepared as described in WO 96/22356 | 155 (9) | 88 (4) | 69 |
| 6 | $C_8F_{15}OCH_3$ prepared as described in WO 96/22356 using perfluoromethyl cyclohexyl carbonyl fluoride and dimethyl sulfate | 143 (8) | 84 (4) | 73 |
| 7 | $C_8F_{15}OC_2H_5$ prepared as described in WO 96/22356 | 144 (4) | 86 (4) | 71 |
| 8 | $[(CF_3)_2CF]_2C{=}C(CF_3)OCH_2C_2F_4H$, commercially available as Folitol ™ 163 from the PERM branch of the State Institute of Applied Chemistry, St Petersburg, Russian Federation | 156 (12) | 91 (5) | 69 |
| 9 | $CF_3CHFCF_2OCH_3$ commercially available from Fluorochem Ltd. | 149 (9) | 96 (6) | 69 |
| 10 | $C_4F_9OCH_2Cl$, prepared by the free radical chlorination of the compound of Example 1 | 140 (7) | 92 (1) | 64 |
| 11 | $[HF_2COC_2F_4]_2O$ prepared as described in U.S. Pat. No. 5,476,974 (Moore et al.) by decarboxylation of $[CH_3O(CO)F_2COC_2F_4]_2O$ | 153 (16) | 86 (7) | 69 |
| 12 | $C_4F_9OCH_3$ with 15% FC-40 ™ (a perfluorotrialkyl amine available from the 3M Company) | 158 (25) | 99 (10) | 69 |
| 13 | $C_4F_9OCH_3$ with 5 wt % $C_{10}H_{21}OC_9F_{17}$, prepared as described in EP 565118 | 141 (6) | 83 (2) | 72 |
| 14 | $C_4F_9OCH_3$ with 5 wt % Krytox ™ FSM | 142 (12) | 84 (8) | 60 |
| C-1 | Molydee ™ Tapping Fluid (available from Castrol Industies Inc.) | 111 (9) | 92 (8) | 54 |
| C-2 | $CF_3CHFCHFC_2F_5$ (available as Vertrel ™ XF from DuPont) | 175 (23) | 101 (9) | 72 |
| C-3 | $C_6F_{13}H$ prepared by reduction of $C_6F_{13}SO_2F$ to the sulfinate with sodium sulfite, followed by thermal desulfinylation | 161 (13) | 96 (8) | 63 |
| C-4 | FC-40 ™ (available from the 3M Company) | 152 (33) | 87 (15) | 64 |
| C-5 | $(C_4F_9)_3N$ (available from the 3M Company) | 142 (11) | 103 (18) | 66 |

The bit and hole temperatures were similar for all hydrofluoroether coolant lubricant fluids tested. The hydrofluorocarbon fluids used in Comparative Examples C-2 and C-3 resulted in an increase in the bit temperature with each hole run which can be seen in the larger standard deviation reported for these Examples. Moly-dee™ tapping fluid used in Comparative Example C-1 produced excessive amounts of an irritating smoke during testing. Despite the low bit temperatures and lower machine load observed with Moly-dee tapping fluid, the irritating smoke produced would make its use prohibitive in this type of machining operation. A small amount of smoke associated with residual oil on the threading bits was also noted in the first holes threaded in Example 8 and Comparative Examples C-2 and C-3. Some dark staining of the bits was noted for all test fluids, however, none was as extensive as that observed with Moly-dee tapping fluid. Furthermore, the work piece was cleaned after machining to remove the Moly-dee residue in Comparative Example C-1. No other fluid tested appeared to leave a residue that required cleaning. The threading bit was observed to slip in the chuck in Example 13 resulting in the hole not being completely threaded.

A test with a standard thread gauge indicated that all of the coolant lubricants tested produced threads which were within normal specifications. The last holes of the triplicates in Examples 1, 4, and 13 were slightly looser than the others tested.

These Examples (1 to 11) show that hydrofluoroether coolant lubricant fluids perform better than comparable fluorocarbon containing fluids (C-2 to C-4) or a conventional tapping fluid (C-1) in thread forming of titanium. Small amounts of lubricous additives can also improve the performance of the fluid $C_4F_9OCH_3$ by reducing bit temperatures (Examples 12 to 14).

Examples 15 to 17 demonstrate thread forming done in aluminum (Type 2024-T3) using hydrofluoroether coolant lubricant fluids. The threading of ⅜–16, ¼ –28 and 8–32 threads was done in a 1 inch thick block of type 2024 -T3 aluminum. The holes were predrilled using Cimtech™ 3900 lubricant and high speed steel twist bits with a Mitsura MC-600VF CNC machine. The threading bits, Chromflo™ GH5 high speed steel, were run at 50 surface feet/min (about 1524 surface cm/min)with coolant lubricant fluid applied from a squeeze bottle at a flow rate of 30–35 mLs/min. Comparative Example C-5 was done with Cimtech™ 3900, a water based hydrocarbon coolant lubricant, applied in a flood mode. The lubricants were as follows:

| Example | Fluid |
|---|---|
| 15 | $C_7F_{13}OCH_3$ |
| 16 | $C_4F_9OC_2H_5$ |
| 17 | $C_4F_9OCH_3$ |
| C-6 | Cimtech ™ 3900 |

The threading was accomplished with no observable differences between hydrofluoroether coolant lubricant fluids and Cimtech 3900 fluid during machining and the resulting threads passed inspection with a standard thread gauge. However, the threads produced with hydrofluoroether coolant/lubricant fluids appeared to be brighter, shinier in appearance than those produced with Cimtech 3900™. In addition, the threads produced with hydrofluoroether fluids were clean and dry shortly after machining.

Figure 2:
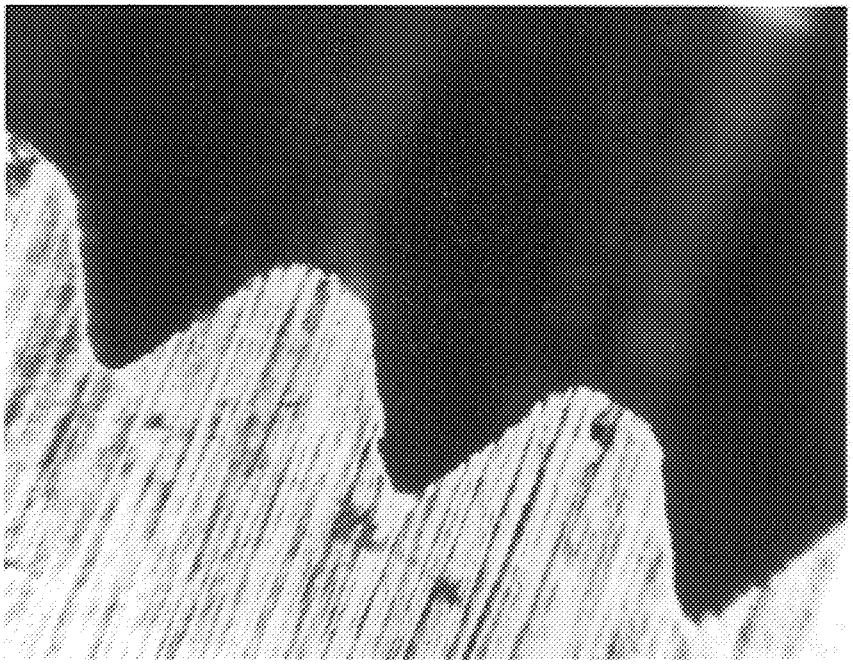
FIG. 2 provides a a photomicrograph of a thread cross-section produced by a threadforming operation using a composition comprising a hydrofluoroether fluid.

The aluminum workpiece was then cut through each line of threaded holes so that the thread surface could be examined. Threads produced with Cimtech 3900™ were not as fully formed as those with the hydrofluoroether coolant/lubricant fluids. Photomicrographs of the thread cross-section produced with Cimtech 3900 had an "M" shape, as can be seen in FIG. 1, while the hydrofluoroether coolant lubricant fluid threads had a fully finished triangular shape, FIG. 2.

These data indicate that the hydrofluoroether fluids can be used as a coolant/lubricant fluid in forming threads in aluminum and that the resulting threads are fully formed while a water based lubricant produced incompletely formed threads.

Examples 18 to 20 demonstrate that hydrofluoroether fluids can be used for knurling copper. A 10½" copper cylinder was knurled with a 100 grooves per inch helical knurl on a metal lathe (Lodge and Shipley) run at 45 rpm, 0.0125 inches per revolution, and 34–38 psi pressure on the knurling tool. Test coolant lubricant fluids were used to keep the copper roll fully wetted in the area of the machining. A band of about 1 to 1½" of knurl was produced in three passes with each hydrofluoroether coolant lubricant fluid. Conventional lubricants, kerosene and Vactra #2 (a hydrocarbon based lubricant available from Mobil Oil Co) were used as a controls in Comparative Examples C-6 and C-7. The lubricants used were as follows:

| Example | Fluid |
|---|---|
| 18 | $C_7F_{13}OCH_3$ |
| 19 | $C_4F_9OC_2H_5$ |
| 20 | $C_4F_9OCH_3$ |
| C-6 | Kerosene |
| C-7 | Vactra #2 ™ |

The quality of the grooves and peaks produced was examined microscopically at 10× and 20× and judged on the completeness of knurl formation and defect level observed. Each of the hydrofluoroether coolant lubricant fluids were judged to be equivalent to the kerosene control. Knurls produced with the Vactra #2 were judged to have significantly more defects, principally on the peaks formed.

These examples show that knurling done with hydrofluoroether coolant lubricant fluids is equivalent to that done with kerosene and superior to that done with Vactra #2. In addition, both the kerosene and Vactra #2 lubricants required additional cleaning to produce a clean and dry surface while the hydrofluoroethers were clean and dry after machining.

We claim:

1. A composition to aid in the forming of metal comprising a hydrofluoroether.

2. The composition of claim 1 wherein the hydrofluoroether is selected according to the formula:

$$(R_1—O)_n—R_2$$

wherein:

n is a number from 1 to 3 inclusive;

$R_1$ and $R_2$ are the same or are different from one another and are selected from the group consisting of substituted and unsubstituted alkyl, aryl, and alkylaryl groups and their derivatives;

with the proviso that at least one of said $R_1$ and $R_2$ contains at least one fluorine atom, and at least one of $R_1$ and $R_2$ contains at least one hydrogen atom;

and further wherein one or both of $R_1$ and $R_2$ may contain one or more catenary or noncatenary heteroatoms; may contain one or more functional groups; may be linear, branched, or cyclic; may contain one or more unsaturated carbon-carbon bonds; and may contain one or more chlorine atoms with the proviso that where such chlorine atoms are present there are at least two hydrogen atoms on the $R_1$ or $R_2$ group on which they are present.

3. The composition of claim 1 wherein the hydrofluoroether is selected according to the formula:

$$R_{f—O—R}$$

wherein:

$R_f$ contains at least one fluorine atom and is selected from the group consisting of substituted and unsubstituted alkyl, aryl, and alkylaryl groups and their derivatives;

R contains no fluorine atoms and is selected from the group consisting of substituted and unsubstituted alkyl, aryl, and alkylaryl groups and their derivatives.

4. The composition of claim 1 wherein the hydrofluoroether is selected from the group consisting of: $C_3F_7OCH_3$, $C_3F_7OC_2H_5$, $C_4F_9OCH_3$, $C_4F_9OCH_2Cl$, $C_4F_9OC_2H_5$, $C_7F_{13}OCH_3$, $C_7F_3OC_2H_5$, $C_8F_{15}OCH_3$, $C_8F_{15}OC_2H_5$, $C_{10}F_2$, $OCH_3$, and $C_{10}F_{21}OC_2H_5$.

5. The composition of claim 1 wherein said composition further comprises a perfluorinated compound.

6. The composition of claim 1 wherein said composition further comprises one or more perfluorinated compounds selected from the group consisting of: perfluoropentane, perfluorohexane, perfluoroheptane, perfluorooctane, perfluoromethylcyclohexane, perfluorotripropyl amine, perfluorotributyl amine, perfluorotriamyl amine, perfluorotrihexyl amine, perfluoro-N-methylmorpholine, perfluoro-N-ethylmorpholine, perfluoro-N-isopropyl morpholine, perfluoro-N-methyl pyrrolidine, perfluoro-1,2-bis (trifluoromethyl)hexafluorocyclobutane, perfluoro-2-butyltetrahydrofuran, perfluorotriethylamine, and perfluorodibutyl ether.

7. The composition of claim 1 further comprising lubricious additive.

8. The composition of claim 7 wherein said lubricious additive is selected from the group consisting of: saturated and unsaturated aliphatic hydrocarbons; naphthalene hydrocarbons; polyoxyalkylenes; aromatic hydrocarbons; thiol esters; oligomers of chlorotrifluoroethylene, chlorinated hydrocarbons; chlorinated perfluorocarbons; phosphates, fatty acid esters, and alkylene glycol esters.

9. The composition of claim 7 wherein said lubricious additive is selected from the group consisting of fluorinated alkylated compounds comprising one or more perfluoroalkyl groups coupled to one or more hydrocarbon groups through a functional moiety.

10. A method of forming metal comprising applying to said metal a composition comprising a hydrofluoroether and forming the metal.

11. The method of claim 7 wherein said application is made prior to the forming of the metal.

12. The method of claim 7 wherein said application is made during the forming of the metal.

13. The method of claim 7 wherein the hydrofluoroether is selected according to the formula:

$$(R_1—O)_n—R_2$$

wherein:

n is a number from 1 to 3 inclusive;

$R_1$ and $R_2$ are the same or are different from one another and are selected from the group consisting of substituted and unsubstituted ally, aryl, and alkylaryl groups and their derivatives;

with the proviso that at least one of said $R_1$ and $R_2$ contains at least one fluorine atom, and at least one of $R_1$ and $R_2$ contains at least one hydrogen atom;

and further wherein one or both of $R_1$ and $R_2$ may contain one or more catenary or noncatenary heteroatoms; may contain one or more functional groups; may be linear, branched, or cyclic; may contain one or more unsaturated carbon-carbon bonds; and may contain one or more chlorine atoms with the proviso that where such chlorine atoms are present there are at least two hydrogen atoms on said $R_1$ and/or $R_2$ group.

14. The method of claim 7 wherein the hydrofluoroether is selected according to the formula:

$$R_f—O—R$$

wherein:

$R_f$ contains at least one fluorine atom and is selected from the group consisting of substituted and unsubstituted alkyl, aryl, and alkylaryl groups and their derivatives;

R contains no fluorine atoms and is selected from the group consisting of substituted and unsubstituted alkyl, aryl, and alkylaryl groups and their derivatives.

15. The method of claim 7 wherein the hydrofluoroether is selected from the group consisting of: $C_3F_7OCH_3$, $C_3F_7OC_2H_5$, $C_4F_9OCH_3$, $C_4F_9OCH_2Cl$, $C_4F_9OC_2H_5$, $C_7F_{13}OCH_3$, $C_7F_{13}OC_2H_5$, $C_8F_{15}OCH_3$, $C_8F_{15}OCH_2H_5$, and $C_{10}F_{21}OCH_3$, and $C_{10}F_{21}OC_2H_5$.

16. The method of claim 7 wherein said composition further comprises a perfluorinated compound.

17. The method of claim 7 wherein said composition further comprises one or more perfluorinated compounds selected from the group consisting of: perfluoropentane, perfluorohexane, perfluoroheptane, perfluorooctane, perfluoromethylcyclohexane, perfluorotripropyl amine, perfluorotributyl amine, perfluorotriamyl amine, perfluorotrihexyl amine, perfluoro-N-methylmorpholine, perfluoro-N-ethylmorpholine, perfluoro-N-isopropyl morpholine, perfluoro-N-methyl pyrrolidine, perfluoro-1,2-bis (trifluoromethyl)hexafluorocyclobutane, perfluoro-2-butyltetrahydrofuran, perfluorotriethylamine, and perfluorodibutyl ether.

18. The method of claim 10 wherein said composition further comprises lubricious additive.

19. The method of claim 18 wherein said lubricious additive is selected from the group consisting of: saturated and unsaturated aliphatic hydrocarbons; naphthalene hydrocarbons; polyoxyalkylenes; aromatic hydrocarbons; thiol esters; oligomers of chlorotrifluoroethylene, chlorinated hydrocarbons; chlorinated perfluorocarbons; phosphates; fatty acid esters; and alkylene glycol esters.

20. The method of claim 18 wherein said lubricious additive is selected from the group consisting of fluorinated alkylated compounds comprising one or more perfluoroalkyl groups coupled to one or more hydrocarbon groups through a functional moiety.

* * * * *

UNITED STATES PATENT AND TRADEMARK OFFICE

CERTIFICATE OF CORRECTION

PATENT NO. : 5,839,311
DATED : November 24, 1998
INVENTOR(S) : Mark W. Grenfell et al.

It is certified that error appears in the above-identified patent and that said Letters Patent is hereby corrected as shown below:

Title page,
Item [73] Assignee: Please delete "Minnesota Mining and Manufacturing Company" and insert in place thereof -- 3M Innovative Properties Company --.

Column 2,
Line 44, please delete the word "haflium" and insert in place thereof -- hafnium --.

Column 9,
Line 11, please delete $C_7F_3OC_2H_5$" and insert in place thereof -- $C_7F_{13}OC_2H_5$ --.
Line 12, please delete "$C_{10}F_2OCH_3$" and insert in place thereof -- $C_{10}F_{21}OCH_3$ --.
Line 58, please delete the word "ally" and insert in place thereof -- alkyl --.

Signed and Sealed this

Eighteenth Day of September, 2001

*Attest:*

Nicholas P. Godici

*Attesting Officer*

NICHOLAS P. GODICI
*Acting Director of the United States Patent and Trademark Office*